US008425081B2

(12) United States Patent
Osawa

(10) Patent No.: US 8,425,081 B2
(45) Date of Patent: Apr. 23, 2013

(54) LED LAMP

(75) Inventor: Hideharu Osawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 350 days.

(21) Appl. No.: 12/993,050

(22) PCT Filed: May 28, 2009

(86) PCT No.: PCT/JP2009/059751
§ 371 (c)(1),
(2), (4) Date: Nov. 16, 2010

(87) PCT Pub. No.: WO2009/145246
PCT Pub. Date: Dec. 3, 2009

(65) Prior Publication Data

US 2011/0063839 A1 Mar. 17, 2011

(30) Foreign Application Priority Data

May 29, 2008 (JP) ..... 2008-140319

(51) Int. Cl.
*F21V 21/00* (2006.01)

(52) U.S. Cl.
USPC ..... 362/249.02; 362/84; 362/217.08; 362/235; 362/294; 362/311.02

(58) Field of Classification Search ..... 362/84, 362/217.08, 223, 235, 249.02, 260, 294, 362/311.02
See application file for complete search history.

(56) References Cited

U.S. PATENT DOCUMENTS

| | | | | |
|---|---|---|---|---|
| 7,918,580 | B2 * | 4/2011 | Liu | 362/217.08 |
| 2010/0253226 | A1 * | 10/2010 | Oki | 362/249.02 |

FOREIGN PATENT DOCUMENTS

| | | |
|---|---|---|
| JP | U-H06-54103 | 7/1994 |
| JP | 7-231120 | 8/1995 |
| JP | 2002-141555 | 5/2002 |
| JP | 2004-30929 | 1/2004 |
| JP | 2008-75080 | 4/2008 |

* cited by examiner

*Primary Examiner* — Stephen F Husar
(74) *Attorney, Agent, or Firm* — Hamre, Schumann, Mueller & Larson, P.C.

(57) ABSTRACT

An LED lamp A1 includes a plurality of LED modules 30 and a hollow diffusion pipe 20 accommodating the LED modules 30. Each LED module 30 includes an LED 31, and a resin package 32 covering the LED 31. The resin package 32 includes a light emission surface 35 opposed to the inner surface 21 of the diffusion pipe 20 and internally diffuses the light from the LED 31 to allow the light to be emitted from the light emission surface 35. The light emission surface 35 and the inner surface 21 of the diffusion pipe 20 are spaced from each other by a distance that is smaller than the distance between the light emission surface 35 and the LED 31. The arrangement reduces light distribution non-uniformity while increasing the amount of light emission.

5 Claims, 3 Drawing Sheets

LED LAMP

TECHNICAL FIELD

The present invention relates to an LED lamp which uses light emitting diodes (LEDs) as the light source and can be fitted to a general-purpose fluorescent lighting fixture as a substitute for a fluorescent lamp.

BACKGROUND ART

FIG. 5 shows a conventional LED lamp (see Patent Document 1 for example) in a sectional view. The LED lamp X illustrated in the figure includes an elongated rectangular substrate 91, a plurality of LEDs 92 mounted on the substrate 91, a tube 93 accommodating the substrate 91, and terminals 94. The substrate 91 is formed with a wiring pattern, not shown, connected to the LEDs 92 and the terminals 94. In the LED lamp X, the terminals 94 can be fitted into the inlet ports of a socket of a general-purpose fluorescent lighting fixture so that the LEDs 92 can be turned on.

The term general-purpose fluorescent lighting fixture refers to fluorescent lighting fixtures commonly used for interior lighting as the main application, and more specifically, lighting fixtures which use, for example in Japan, a commercial 100-volt or 200-volt power supply and to which a JIS C7617 straight-tube fluorescent lamp or a JIS C7618 circular fluorescent lamp can be attached.

However, since the LEDs 92 are spaced apart from each other in the LED lamp X, the light emitted from the LED lamp may not be uniform. Such non-uniformity can be corrected, for example, by increasing the wall thickness of the tube 94 thereby increasing light diffusion. In this case, however, the tube 94 has a decreased translucency, which poses another problem of decreased amount of light emission from the LED lamp X. Thus, the LED lamp X has not been an ideal substitute for a fluorescent lamp.

Patent Document 1: JP-U-6-54103

DISCLOSURE OF THE INVENTION

Problems to be Solved by the Invention

The present invention has been proposed under the above-described circumstances, and it is therefore an object of the present invention to provide an LED lamp which has decreased light distribution non-uniformity and yet emits a sufficient amount of light.

Means for Solving the Problem

To solve the above-described problem, the present invention takes the following technical measures.

An LED lamp provided according to the present invention includes a plurality of LED modules, and a hollow pipe accommodating the LED modules and allowing at least part of light from the LED modules to pass through. Each of the LED modules includes an LED, and a resin package covering the LED. The resin package includes a light emission surface opposed to the inner surface of the pipe and internally diffuses the light from the LED to allow the light to be emitted from the light emission surface. The light emission surface and the inner surface of the pipe are spaced from each other by a distance that is smaller than the distance between the light emission surface and the LED.

In a preferred embodiment of the present invention, the pipe diffuses and passes light from the LED modules.

In a preferred embodiment of the present invention, the resin package includes a first protection layer directly covering the LED, and a second protection layer covering the first protection layer and including the light emission surface. The first protection layer contains a fluorescent material.

In a preferred embodiment of the present invention, the second protection layer internally diffuses light emitted from the first protection layer before the light is emitted from the light emission surface.

In a preferred embodiment of the present invention, the resin package is in the shape of a half cylinder, with the light emission surface being along the inner surface of the pipe.

Other features and advantages of the present invention will become clearer from the detailed description given below with reference to the accompanying drawings.

BEST MODE FOR CARRYING OUT THE INVENTION

Preferred embodiments of the present invention are described below with reference to the drawings.

Figure 1:
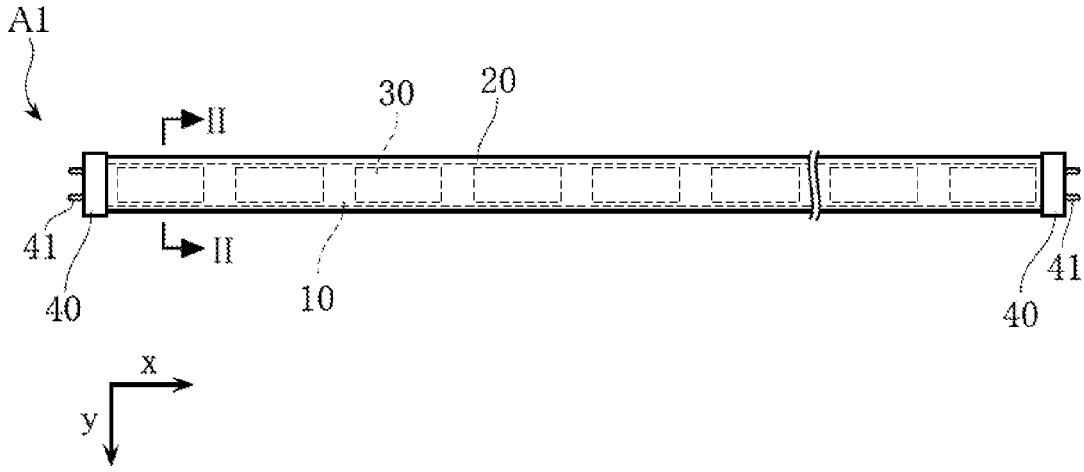
FIG. 1 is a plan view showing an LED lamp according to a first embodiment of the present invention.
Figure 2:
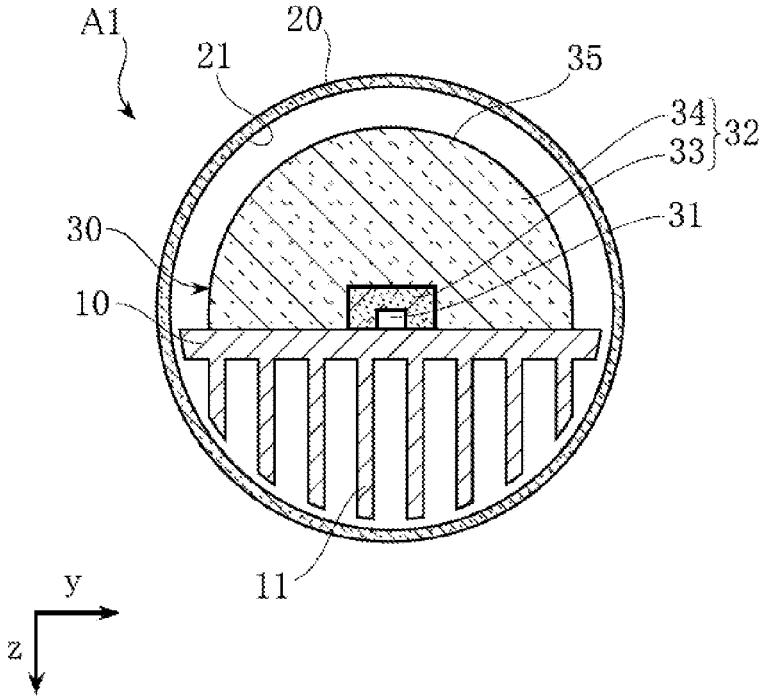
FIG. 2 is a sectional view taken along lines II-II in FIG. 1.

FIG. 1 and FIG. 2 show an LED lamp according to a first embodiment of the present invention. The LED lamp A1 according to the present embodiment includes a substrate 10, a diffusion pipe 20, LED modules 30 and bases 40, and has a cylindrical shape elongated in direction x overall. The LED lamp A1 can be used as a substitute for a straight-tube fluorescent lamp by fitting to a general-purpose fluorescent lighting fixture.

The substrate 10 is made of e.g. Al, provided with a plurality of heat dissipation plates 11 and elongated in direction x. The width direction of the substrate 10 will be called direction y whereas the thickness direction of the substrate will be called direction z. The obverse surface of the substrate 10 is formed with a wiring pattern, not shown. Each of the heat dissipation plates 11 protrudes from the reverse surface of the substrate 10 in direction z, substantially over the entire length of the substrate 10 in direction x. The heat dissipation plates 11 are parallel to each other and disposed side by side in direction y.

The diffusion pipe 20 serves to dissipate the light emitted from the LED modules 30 and is in the shape of a straight tube elongated in direction x. The diffusion pipe 20 is circular in cross section with the outside diameter being 32.5 mm, and accommodates the substrate 10 and the LED modules 30.

The LED modules 30 are disposed on the substrate 10 to be aligned in direction x. Each LED module 30 includes an LED 31, and a resin package 32 which protects the LED. The LED 31 is electrically connected to the wiring pattern, not shown, on the substrate 10.

The LED 31 has a laminated structure made up of e.g. an n-type semiconductor layer, a p-type semiconductor layer and an active layer sandwiched between them. The LED 31 is provided by a GaN semiconductor for example and capable of emitting blue light. The LED 31 has a square shape in a plan view, with each side having a length of 1 mm. The LED 31 is disposed at the center of the LED module 30.

The resin package 32 is in the shape of an elongated half cylinder extending in direction x and made of a material that allows light from the LED 31 to pass through it, such as a silicone resin. The resin package includes a first protection layer 33 and a second protection layer 34. For instance, the resin package 32 has a diameter of 22 mm and a length of 40 mm in direction x. The first protection layer 33 is in the shape of a rectangular parallelepiped that covers the LED 31, and contains a fluorescent material that emits yellow light when excited by blue light. The second protection layer 34 is opaque white and internally diffuses the light from the LED 31 before the light is emitted from the light emission surface 35 provided on the outer circumference. The light emission surface 35, which comprises part of the outer circumferential surface of the cylinder, is opposed to the inner surface 21 of the diffusion pipe 20. The light emission surface 35 and the inner surface 21 are spaced by a distance which is smaller than the distance between the light emission surface 35 and the LEDs 31. The resin package 32 occupies a relatively large area in cross section of the diffusion pipe 20.

The bases 40 are each formed like a cylinder extending in direction x, and support two terminal pins 41. The bases 40 are respectively attached to the ends of the substrate 10 in direction x, with each terminal pin 41 electrically connected to the wiring pattern, not shown, on the substrate 10. When the terminal pins 41 are fitted into a socket in a fluorescent lighting fixture, electric power can be supplied to the LED modules 30 to turn on the LEDs 31.

The advantages of the LED lamp A1 are described below.

According to the present embodiment, blue light emitted from the LED 31 mixes with yellow light generated by the fluorescent material in the first protection layer 33 to become while light, which then enters the second protection layer 34. The light entering the second protection layer 34 is diffused internally within the opaque-white second protection layer 34 and is then emitted from the light emission surface 35, diffusing to form an oval pattern in a plan view. The light emitted from the plurality of light emission surfaces 35, which are aligned in direction x, is further diffused by the diffusion pipe 20 before emission to the outside. Consequently, the light emitted from the LED lamp A1 has less non-uniformity in direction x. Further, since the LED lamp A1 has the second protection layers 34 which diffuse light to a sufficient level, it is possible to make the diffusion pipe 20 thin enough to increase the light emission amount. Therefore, the LED lamp A1 can be used as a suitable substitute for a straight-tube fluorescent lamp.

Also, since the substrate 10 is provided with a plurality of heat dissipation plates 11 in the present embodiment, heat generated during the lighting of the LEDs is efficiently dissipated. This suppresses the deterioration of the LEDs 31, so that the LED lamp A1 provides stable lighting.

Figure 3:
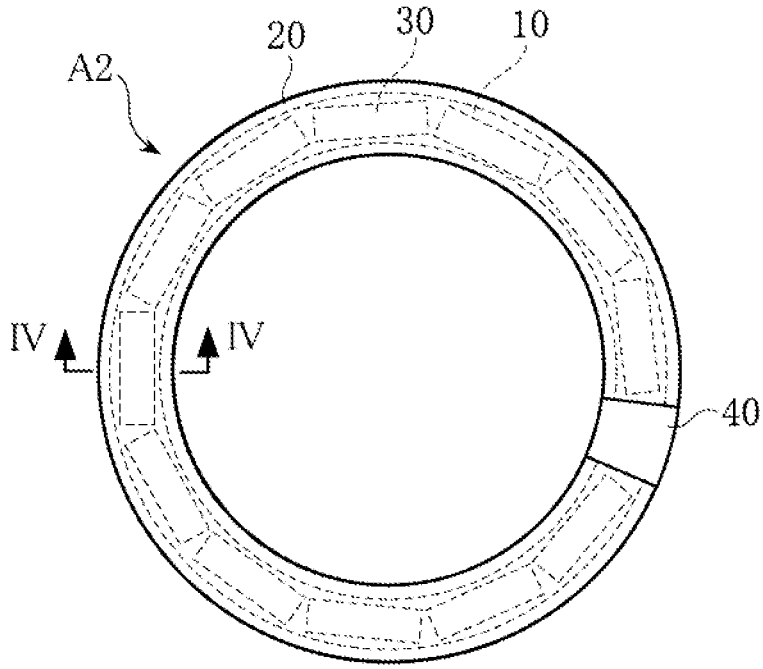
FIG. 3 is a plan view showing an LED lamp according to a second embodiment of the present invention.
Figure 4:
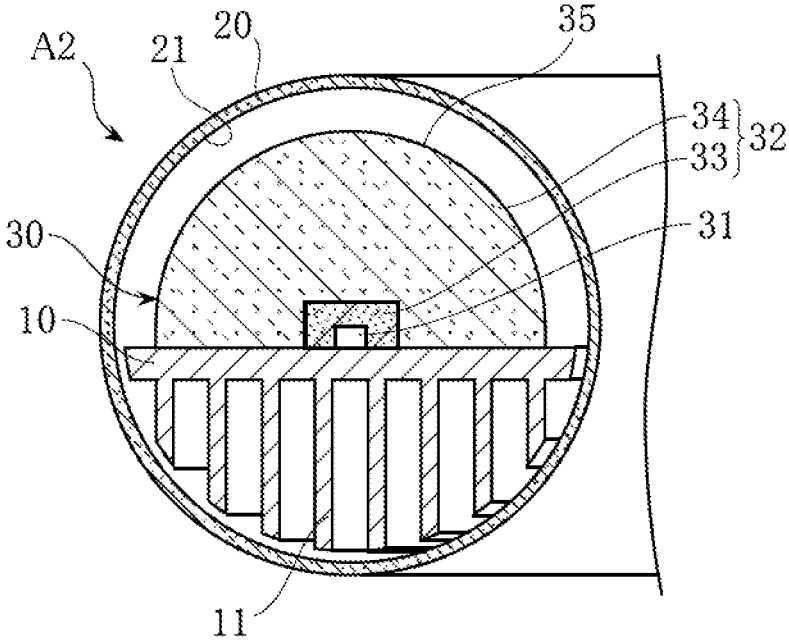
FIG. 4 is a sectional view taken along lines IV-IV in FIG. 3.
Figure 5:
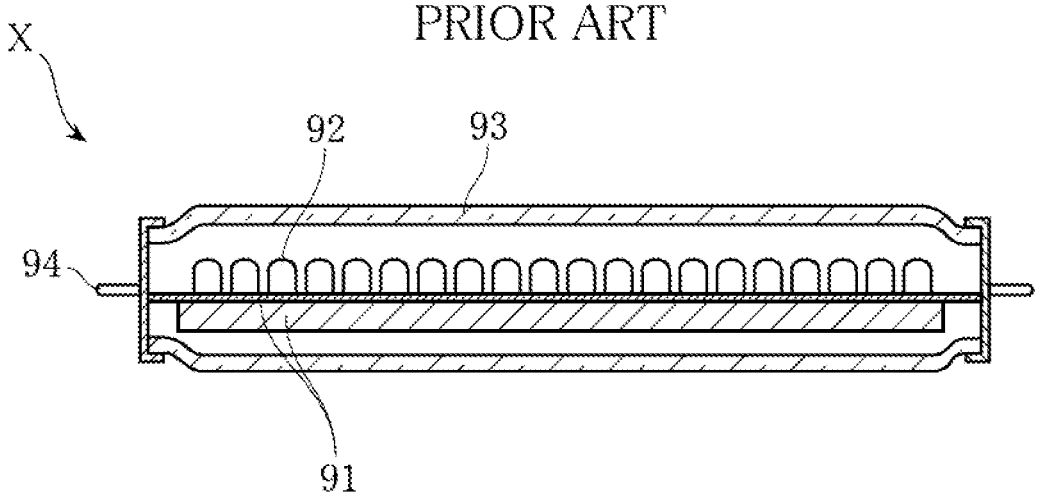
FIG.5 PRIOR ART
FIG. 5 is a sectional view showing a conventional LED lamp.

FIG. 3 and FIG. 4 show an LED lamp according to a second embodiment of the present invention. The LED lamp A2 according to the present embodiment includes a substrate 10, a diffusion pipe 20, LED modules 30 and a base 40, and is annular. The LED lamp A2 can be used as a substitute for a circular fluorescent lamp by fitting to a general-purpose fluorescent lighting fixture.

The substrate 10 is made of e.g. Al, provided with a plurality of heat dissipation plates 11, and annular in a plan view. The obverse surface of the substrate 10 is formed with a wiring pattern, not shown. The heat dissipation plates 11 protrude from the reverse surface of the substrate 10, are parallel to each other, and are disposed side by side radially of the substrate 10.

The diffusion pipe 20 serves to dissipate the light emitted from the LED modules 30 and is annular in a plan view. The diffusion pipe 20 has a circular cross section having an outside diameter of 29 mm, and accommodates the substrate 10 and the LED modules 30.

As the LED modules 30 of the LED lamp A2, LED modules of the same type as those of the LED lamp A1 can be employed. As shown in FIG. 3 for example, in the LED lamp A2, twelve LED modules 30 are arranged circumferentially of the substrate 10.

The base 40 has terminal pins, not shown, electrically connected to the wiring pattern, not shown, on the substrate 10. When the terminal pins 41 of the base 40 is fitted into the socket in a fluorescent lighting fixture, electric power can be supplied to the LED modules 30 to turn on the LEDs 31.

With the LED lamp A2, light emitted from a plurality of LED modules 30 is diffused sufficiently, which decreases light distribution non-uniformity in the circumferential direction. Further, it is possible to make the diffusion pipe 20 thin enough to increase the light emission amount. Therefore, the LED lamp A2 can be used as a suitable substitute for a circular fluorescent lamp.

Also, since the substrate 10 is provided with a plurality of heat dissipation plates 11 as in the previous embodiment, heat generated during the lighting of the LEDs 31 is efficiently dissipated. This suppresses the deterioration of the LEDs 31, so that the LED lamp A2 provides stable lighting.

Since the straight-tube LED lamp A1 and the circular LED lamp A2 can use the LED modules 30 of the same type, the efficiency in making the two kinds of lamps is improved.

The LED lamp according to the present invention is not limited to the foregoing embodiments. The specific structure of each part of the LED lamp according to the present invention may be varied in design in many ways.

The size of the resin package 32 can be appropriately changed in accordance with the diameter of the diffusion pipe 20. Further, the first protection layer 33 and the second protection layer 34 of the resin package 32 may have any proportion to each other as long as the second protection layer 34 has a greater proportion.

For instance, the substrate and the heat dissipation plates may be separate members from each other. Also, the pipe may have an opening. The pipe in the present invention is not limited to those which diffuse light emitted from the LED modules, but may be those which simply pass the light emitted from the LED modules without diffusing it.

The invention claimed is:

1. An LED lamp comprising:

a plurality of LED modules; and a hollow pipe accommodating the LED modules and allowing at least part Of light from the LED modules to pass through; wherein:

each of the LED modules includes an LED, and a resin package covering the LED;

the resin package includes a light emission surface opposed to an inner surface of the pipe and internally diffuses the light from the LED to allow the light to be emitted from the light emission surface; and the light emission surface and the inner surface of the pipe are spaced from each other by a distance that is smaller than a distance between the light emission surface and the LED.

2. The LED lamp according to claim 1, wherein the pipe diffuses and passes light from the LED modules.

3. The LED lamp according to claim 1, wherein the resin package includes a first protection layer directly covering the LED, and a second protection layer covering the first protection layer and including the light emission surface, the first protection layer containing a fluorescent material.

4. The LED lamp according to claim 3, wherein the second protection layer internally diffuses light emitted from the first protection layer before the light is emitted from the light emission surface.

5. The LED lamp according to claim 1, wherein the resin package is in a shape of a half cylinder, with the light emission surface being along the inner surface of the pipe.

* * * * *